United States Patent [19]

Chen et al.

[11] Patent Number: 4,749,467

[45] Date of Patent: Jun. 7, 1988

[54] LUBE DEWAXING METHOD FOR EXTENSION OF CYCLE LENGTH

[75] Inventors: Nai Y. Chen, Titusville; Bruce P. Pelrine, Lawrenceville, both of N.J.

[73] Assignee: Mobil Oil Corporation, New York, N.Y.

[21] Appl. No.: 54,115

[22] Filed: May 22, 1987

Related U.S. Application Data

[63] Continuation of Ser. No. 870,069, Jun. 3, 1986, abandoned, which is a continuation-in-part of Ser. No. 724,858, Apr. 18, 1985, abandoned.

[51] Int. Cl.[4] ..... L10G 65/10

[52] U.S. Cl. ..... 208/59; 208/18; 208/74; 208/111; 208/155; 502/20

[58] Field of Search ..... 208/111, 18, 59, 74, 208/155; 502/20

[56] References Cited

U.S. PATENT DOCUMENTS

| | | | |
|---|---|---|---|
| Re. 28,398 | 4/1975 | Chen et al. | 208/111 |
| 3,291,719 | 12/1966 | Dill | 208/120 |
| 3,418,256 | 12/1968 | Rigney et al. | 252/415 |
| 3,579,436 | 5/1971 | Mounce | 208/59 |
| 3,668,113 | 6/1972 | Burbidge et al. | 208/97 |
| 3,686,093 | 8/1972 | Irvine | 208/59 |
| 3,755,138 | 8/1973 | Chen et al. | 208/33 |
| 3,904,510 | 9/1975 | Sinfelt et al. | 208/140 |
| 3,956,102 | 5/1976 | Chen et al. | 208/93 |
| 3,986,982 | 10/1976 | Crowson et al. | 252/415 |
| 4,100,056 | 7/1978 | Reynolds et al. | 208/57 |
| 4,211,635 | 7/1980 | Chen | 208/111 |
| 4,213,847 | 7/1980 | Chen et al. | 208/111 |
| 4,222,855 | 9/1980 | Pelrine et al. | 208/111 |
| 4,229,282 | 10/1980 | Peters et al. | 208/18 |
| 4,247,388 | 1/1981 | Banta et al. | 208/111 |
| 4,305,808 | 12/1981 | Bowes et al. | 208/111 |
| 4,357,232 | 11/1982 | Holland et al. | 208/87 |
| 4,372,839 | 2/1983 | Oleck et al. | 208/59 |
| 4,390,413 | 6/1983 | O'Rear et al. | 208/111 |
| 4,400,265 | 8/1983 | Shen et al. | 208/97 |
| 4,414,097 | 11/1983 | Chester et al. | 208/59 |
| 4,418,235 | 11/1983 | Haag et al. | 208/111 |
| 4,428,819 | 1/1984 | Shu et al. | 208/46 |
| 4,428,826 | 1/1984 | Walsh | 208/120 |
| 4,443,327 | 4/1984 | Shihabi et al. | 208/109 |
| 4,448,673 | 5/1984 | Shihari | 208/111 |
| 4,501,656 | 2/1985 | Dufresne et al. | 208/111 |
| 4,510,045 | 4/1985 | Dessau | 208/111 |
| 4,536,486 | 8/1985 | Lewis | 208/111 |
| 4,554,065 | 11/1985 | Albinson et al. | 208/59 |
| 4,574,043 | 3/1986 | Chester et al. | 208/59 |

*Primary Examiner*—Helen M. S. Sneed
*Assistant Examiner*—Anthony McFarlane
*Attorney, Agent, or Firm*—Alexander J. McKillop; Michael G. Gilman; Dennis P. Santini

[57] ABSTRACT

An improved method which provides for an extended cycle length in catalytic lube dewaxing of residual lube oil feedstocks and easier catalyst regeneration. The method may incorporate catalytically dewaxing a feedstock in a fixed bed reactor with or without product recycle, or a series of reactors with interreactor separation of vapors from liquids. Improved performance is achieved by operating the reactor at a temperature between about 490° and about 620° F., employing a high activity crystalline zeolite catalyst having an alpha value between about 50 and about 900 based on the zeolite and a space velocity sufficiently low to produce a dewaxed effluent of desired pour point and to maintain an average catalyst aging rate of less than about 2° F. per day. This relatively low temperature operation allows catalyst performance to be restored by simple hydrogen reactivation.

20 Claims, 5 Drawing Sheets

PRODUCT POUR POINTS vs TIME ON-STREAM

EFFECT OF INTERSTAGE SEPARATION ON POUR POINT 1.0 LHSV
400 psig

LUBE DEWAXING METHOD FOR EXTENSION OF CYCLE LENGTH

CROSS REFERENCE TO RELATED APPLICATION

This is a continuation of application Ser. No. 870,069, filed on June 3, 1986, now abandoned which is a continuation-in-part of U.S. parent application Ser. No. 724,858, filed Apr. 18, 1985.

BACKGROUND OF THE INVENTION

1. Field of the Invention

This invention relates to methods for the dewaxing of heavy hydrocarbon liquids to produce lube oil. More particularly, it relates to a method for the dewaxing of heavy hydrocarbon liquids, within a particular range of operating temperature and space velocity, by contact with a catalyst having a high alpha value.

2. Discussion of Prior Art

The dewaxing of hydrocarbons to liquids of lower pour point is a process of great commercial significance. Although alternatives exist, it is now evident that the use of shape-selective catalysts, such as a ZSM-5 type catalyst, to selectively convert those paraffins that contribute the most to high pour points has many advantages over other methods. Thus, catalytic dewaxing over shape-selective zeolites will likely be the most commercially significant dewaxing process in the hydrocarbon processing industry.

Catalytic dewaxing of hydrocarbon oils to reduce the temperature at which precipitation of waxy hydrocarbons occurs is a known process and is described, for example, in the *Oil and Gas Journal*, Jan. 6, 1975, pages 69–73. A number of patents have also described catalytic dewaxing processes. It is known that high pour point oils may be catalytically dewaxed to lower pour point oils over ZSM-5 type zeolite catalysts which selectively crack long chain normal paraffins, slightly branched isoparaffins and long chain cycloparaffins. For example, U.S. Pat. No. Re. 28,398 describes a process for catalytic dewaxing with a catalyst comprising a zeolite of the ZSM-5 type and a hydrogenation/dehydrogenation component. A process for hydrodewaxing a gas oil with a ZSM-5 type catalyst is also described in U.S. Pat. No. 3,956,102. A Mordenite catalyst containing a Group VI or Group VIII metal may be used to dewax a distillate from a waxy crude, as described in U.S. Pat. No. 4,100,056. U.S. Pat. No. 3,755,138 describes a process for mild solvent dewaxing to remove high quality wax from a lube stock, which is then catalytically dewaxed to specification pour point. U.S. Pat. No. 4,222,855 to Pelrine et al discloses dewaxing over a ZSM-23 or a ZSM-35 type catalyst.

Catalytic dewaxing processes may be followed by other processing steps such as hydrodesulfurization and denitrogenation in order to improve the quality of the product. For example, U.S. Pat. No. 3,668,113 describes a catalytic dewaxing process employing a Mordenite dewaxing catalyst which is followed by a catalytic hydrodesulfurization step over an alumina-based catalyst. U.S. Pat. No. 4,400,265 describes a catalytic dewaxing-/hydrodewaxing process using a ZSM-5 type catalyst wherein gas oil is catalytically dewaxed followed by hydrodesulfurization in a cascade system.

In catalytic dewaxing processes using shape-selective catalysts, such as ZSM-5 type catalysts, the waxy components, particularly the n-paraffins, are cracked by the zeolite into lighter products including paraffins, olefins and aromatics, some of which may remain in the lube oil boiling range. Olefinic products are unstable to oxidation and must be removed. They may be removed by treatments such as hydrofinishing which uses catalysts to saturate the olefins and improve the oxidation stability of the oil. The hydrofinishing catalysts generally used are mild hydrogenation catalysts, such as a CoMo-/$Al_2O_3$ type. The color of the oil may also be improved in this hydrofinishing.

U.S. Pat. No. 4,428,819 to Shu et al discloses a process for hydrofinishing a catalytically dewaxed oil in which the residual wax content of the dewaxed oil is isomerized over a hydroisomerization catalyst. Typically, heavier lube fractions (greater than 600° F. b.p.) contain waxy components comprising normal paraffins, branched paraffins and cyclo paraffins. When a shape-selective catalyst, such as HZSM-5, is used to dewax these feeds, the normal paraffins are cracked more selectively than the branched paraffins and cycloparaffins. HZSM-5 is a ZSM-5 type catalyst with only hydrogen attached to its active sites, rather than metals.

In the hydroprocessing of liquid petroleum feedstocks, and particularly so-called heavy feedstocks, it is a basic purpose of the process of catalytic dewaxing to remove lighter conversion products from the liquid petroleum flow while concurrently providing a hydrogenative environment for catalytic conversion, which is particularly utilized in the case of the processing of highly waxy feedstocks. Frequently lighter products, which are obtained from cracking and/or hydrocracking reactions, compete with the heavier feed molecules for access to the cracking sites in zeolites or silica-alumina cracking catalysts which are employed in the implementation of the catalytic dewaxing process. Inasmuch as these lighter products diffuse more rapidly into the catalyst than the larger feed molecules, they have a tendency to retard the rate of conversion of the heavier molecules. Moreover, the lighter products also tend to be either more difficult to crack, such as low molecular weight paraffins, or easier to polymerize, such as low molecular weight olefins. They also possess a tendency to coke more readily than their heavier counterparts, so as to thereby retard the conversion of the heavier molecules to an even greater extent.

This competition between the light and heavy liquid petroleum molecules is rendered particularly critical when there is employed a catalyst which essentially constitutes a shape-selective zeolite; for example, a zeolite exemplified by ZSM-5 for the dewaxing of liquid petroleum or lube stocks. Processes in reactors which utilize aluminosilicate zeolite catalysts, such as ZSM-5 or other zeolites having smaller pore openings, are disclosed in U.S. Pat. No. 4,222,855 to Pelrine et al and in U.S. Reissue Pat. No. Re. 28,398 to N. Y. Chen. Although the utilization of different types of hydroprocessing reactors to implement catalytic dewaxing processes is broadly disclosed in the prior art, as exemplified by the above-mentioned U.S. patents, broadly referring to stirring tank-type reactors or trickle bed reactors, there is an obvious need in the technology to more precisely define specific catalytic dewaxing process designs.

Current technology, as mentioned above, for dewaxing petroleum feedstocks having elevated pour points, involves the use of trickle beds whereby gas (primarily hydrogen) and the feedstock concurrently flow downwardly over a bed of solid catalyst. The three-phase trickle bed concept makes use of an intimate mixing between gas and liquid phases while in contact with the catalyst in order to facilitate dewaxing. Peformance level of the process is gauged by the length of time during which the process is producing products which meet specifications, as well as the minimum temperature required to obtain acceptable products.

U.S. Pat. No. 4,357,232 to Holland et al discloses a dewaxing process which operates at a temperature not to exceed 675° to 700° F., and which pretreats a dewaxing feedstock in a zeolite sorbent bed, which is a type of guard bed, prior to dewaxing.

U.S. Pat. No. 4,247,388 to Banta et al discloses treatment of zeolites to reduce an initially high alpha activity to within a range of 55 to 150 alpha prior to use as catalysts in a hydrodewaxing operation for distillate dewaxing. However, Banta et al is concerned with a steady state equilibrium (line out) distillate dewaxing process. They teach a process for decreasing steady state equilibrium temperature. In their process, as shown by their data, the catalyst deactivates from a start-of-cycle temperature of about 550° F. in a few days to a steady state equilibrium temperature in excess of 700° F.

Distillate dewaxing differs from lube oil dewaxing. Distillate dewaxing may operate at high temperature in excess of 700° F. To produce high quality lube stock, it is necessary to restrict operating temperature to below 675° F. to prevent undesirable reactions resulting in an unstable product. These reactions are less undesirable in distillate dewaxing because the product is used as fuel.

It is particularly difficult to produce lube oils by dewaxing heavy stocks comprising at least 90 wt % of compounds having a boiling point greater than 850° F., such as bright stocks. Following prior art teachings, as shown by present FIG. 7, results in dewaxing bright stocks to 20° F. pour point over short cycles of 15 to 30 days. The catalyst does not reach a steady state temperature before it reaches the end-of-cycle temperature.

In contrast to bright stocks, the dewaxing of light neutrals by the prior art does not have such a high steady state temperature. Therefore dewaxing of light neutrals occurs over relatively longer operating cycles, as seen by present FIG. 8.

The dewaxing summarized in FIGS. 7 and 8 occurred by contacting the respective feedstocks with a fresh alumina bound Ni-ZSM-5 catalyst having an alpha value of 108 based on zeolite. Reactor temperatures are adjusted to 20° F. pour point within 1° F.–2° F. pour point.

Typically, a dewaxing reactor for lube oil dewaxing is operated at a start-of-cycle temperature of about 540° to about 580° F., usually 560° F., and the operating temperature is increased by about 2.0° to about 10.0° F. per day, depending on feed, catalyst and space velocity, to compensate for decreasing catalyst activity and produce a lube of predetermined pour point. As seen in FIG. 8, the operating temperature may be increased less than 2° F. per day after an equilibrium temperature is reached for a light neutral feedstock. Temperature is increased to an end-of-cycle temperature between about 655° and about 695° F., usually about 675° F. At the end of a cycle the reactor is shut down and the catalyst regenerated by contact with hydrogen and, if necessary, by contact with oxygen.

It would be desirable to dewax heavy stocks to produce lube oils over extended cycle lengths. It would also be desirable to operate a dewaxing reactor at conditions which allow simple, effective $H_2$ regeneration of catalyst without a loss of catalyst activity and allow long catalyst life, thus reducing the frequency of regeneration. Furthermore, it would be desirable to provide methods to facilitate the removal of lighter by-products during catalytic dewaxing.

SUMMARY OF THE INVENTION

As part of this invention, some ways to lengthen catalyst life relative to a fixed pour point specification have been discovered. The instant invention does not teach a method to lower the steady state dewaxing temperature or a method to operate a dewaxing process in the steady state. It teaches a novel method of starting the dewaxing process and stretching the operating cycle for heavy lube oil feedstocks far in excess of 30 days. U.S. Pat. No. 4,247,388 to Banta et al, discloses a dewaxing cycle comprising an initial portion wherein dewaxing temperature rose from a start cycle temperature to a temperature of 620° F. in a few days. In contrast, the present invention can stretch its initial portion to hundreds of days. The present method is particularly useful for dewaxing bright stocks to produce lube oil because otherwise dewaxing of bright stocks to produce lube oils is limited to short cycles.

Specifically the invention lengthens catalyst life when dewaxing heavy lube oil stocks by employing a start-of-cycle temperature of 490° F. (254° C.), preferably 500° F. (260° C.), and limiting the end-of-cycle temperature to less than about 620° F. (327° C.), preferably about 600° F. (316° C.), and most preferably less than about 575° F. (302° C.), employing a high activity, shape-selective catalyst, and operating at a low space velocity. The shape-selective catalysts have high activity, as reflected by alpha values between about 50 and about 900 based on zeolite, preferably between about 70 and about 800 based on zeolite, and most preferably between about 200 and about 450 based on zeolite. The space velocity is adjusted to be sufficiently low so that, in combination with the low temperature and high alpha value, the desired pour point product is produced and a low catalyst aging rate is maintained. The desired pour point is at most about 60° F., preferably at most about 40° F. and most preferably at most about 20° F. The average aging rate over a cycle is less than about 2° F. per day, preferably less than about 1° F. per day, and most preferably less than about 0.3° F. per day. Sufficient dewaxing occurs to reduce the pour point of the feedstock by at least 10° F.

While not wishing to limit the present invention, it is believed that dewaxing heavy lube oil feedstocks over a shape selective zeolite, at conditions of low temperature by virtue of high alpha value and low space velocity, reduces catalyst aging by reducing nitrogen poisoning. The high alpha value and low space velocity are employed in the dewaxing process of the present invention to allow desired dewaxing reactions to occur at the low temperatures employed to minimize nitrogen poisoning. Accordingly, this results in a low average catalyst aging rate during a dewaxing cycle. Cycle lengths of several months to a year may be expected.

By limiting the temperature to 620° F. (327° C.), hydrogen reactivation is easier and more complete than if the temperature limit were 675° F. (357° C.), as typically used in commercial practice. By limiting the end-of-cycle reactor temperature to 620° F. (327° C.), fresh catalyst performance may be restored by simple hydrogen reactivation.

The inventive concept also applies the above dewaxing conditions of temperature, alpha value, and space velocity to a method of operating a fixed bed catalytic lube dewaxing unit, with or without recycle, or operating an improved catalytic lube dewaxing unit comprising a series of reactors with inter-reactor separation.

Accordingly, a primary object of the invention is to provide a method for catalytically dewaxing a heavy lube oil feedstock at a temperature between about 490° and 620° F. (254°-327° C.), which employs a high activity catalyst as measured by an alpha value on zeolite between about 50 and 900, and a sufficiently low space velocity to dewax the feedstock to a desired pour point and maintain an average catalyst aging rate of less than about 2° F. per day.

Another object of the invention is to provide a method for catalytically dewaxing a heavy lube oil feedstock at the above specified dewaxing conditions of temperature, alpha value, and space velocity with separation of a dewaxing reactor effluent into vapor and liquid streams and recycle of a portion of the liquid stream back to the reactor.

Another object of the invention is to provide a method for catalytically dewaxing a hydrocarbon feedstock at a temperature between about 500° and about 600° F. (260°-316° C.), which employs a high activity catalyst and low space velocity in a series of reactors with inter-reactor separation to remove a vapor stream from a reactor effluent prior to feeding the effluent to the subsequent stage.

PREFERRED EMBODIMENTS OF THE INVENTION

The present process is applicable to heavy lube feedstocks when a low wax content is desired in the final product and, in particular, is applicable to feeds with pour points higher than 70° F. (21° C.). Heavy lube feedstocks are defined as those comprising at least 90 wt % of compounds having a boiling point greater than about 850° F. (454° C.). Bright stocks are included as a heavy lube feedstock. The feeds may be virgin or pretreated hydrocarbons, such as those which, prior to dewaxing, have undergone furfural treatment, to reduce aromatics content, or propane deasphalting.

Figure 1:
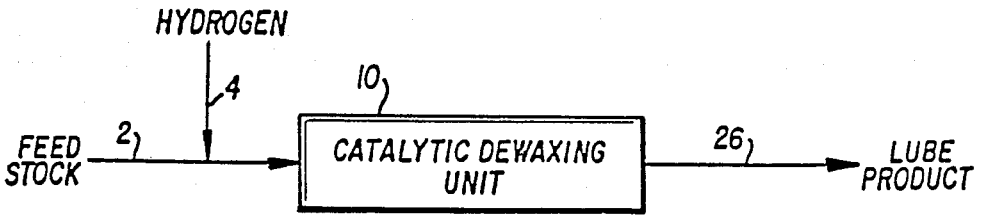
FIG. 1 is a block flow diagram of a first embodiment of the invention showing a single dewaxing unit.

The method of the apparatus is carried out at elevated pressure and temperature, suitable space velocity and suitable hydrogen feed rate. A feedstock 2, as shown in FIG. 1, comprising high pour point, greater than 70° F. (21° C.), or waxy feed, passes through a preheater (not shown) and contacts a dewaxing catalyst contained in a catalytic dewaxing unit 10 to produce a lube product stream 26 of predetermined pour point. It is desired that the lube product stream 26 have a pour point of at most about 60° F. (16° C.), preferably at most about 40° F. (4° C.), and most preferably at most about 20° F. (−7° C.).

The dewaxing unit 10 operates at a temperature between about 490° and about 620° F. (254°-327° C.), preferably between about 500° and about 600° F. (260°-316° C.), and most preferably between about 500° F. and about 575° F. (260°-302° C.). Overall liquid hourly space velocity (LHSV) is maintained sufficiently low to achieve the predetermined pour point while maintaining an average catalyst aging rate less than about 2° F. per day, preferably less than about 1° F. per day, and most preferably less than about 0.3° F. per day. The catalyst aging rate is defined as the increase in catalyst temperature required to maintain a relatively constant product pour point. The average catalyst aging rate is the aging rate averaged over a catalyst cycle from start-of-run to end-of-run. Most preferably the space velocity is also between about 0.01 and about 2.0 LHSV (liquid hourly space velocity). LHSV is defined as ($ft^3$ liquid reactants/hr) per ($ft^3$ catalyst in the unit), wherein feedstock 2 is the liquid reactant for this embodiment. Pressure is between about 100 and about 2000 psig (7-138 bar). A hydrogen feed rate, provided by hydrogen stream 4, is greater than about 500 SCF/bbl of feedstock 2. The product stream 26 may then pass to downstream processing, such as hydro-finishing, to produce final product.

The dewaxing catalyst is a shape-selective zeolite, preferably of the ZSM-5 family, and has an activity measured by an alpha value between about 50 and about 900, preferably between about 70 and about 800, and most preferably between about 200 and about 450, based on the zeolite. It is understood that the unit 10 may contain one or more reactors in series or parallel operations. The reactors are preferably downflow fixed bed reactors, and preferably the hydrogen treat rate to each reactor is between about 500 and 10,000 SCF/bbl. If desired, the feedstock 2 may pass through a catalyst guard bed (not shown) prior to entering the unit 10. The guard bed removes catalyst poisons, which include cyclic heteroatom compounds, such as phenols.

The advantages of the above embodiment result from the combination of low temperature range, high catalyst activity and low space velocity with shape-selective crystalline zeolite catalyst. The combination of conditions and catalyst activity reduces aging rates and allows fresh catalyst performance to be restored by simple hydrogen reactivation.

While not wishing to limit the present invention, it is submitted that dewaxing over a shape selective zeolite, at conditions of low temperature by virtue of high alpha value and low space velocity reduces nitrogen poisoning.

Nitrogen is present in some molecules of a dewaxing feedstock that are too large to pass into the pores of a shape selective zeolite catalyst. The low temperature prevents cracking of these molecules to smaller nitrogen-containing molecules which can pass into the pores of the shape selective catalyst. Thus by preventing formation of smaller nitrogen-containing molecules, the present invention prevents nitrogen from poisoning the interior of the catalyst.

The high alpha value and low space velocity are employed in the dewaxing process of the present invention to allow desired dewaxing reactions to occur at the low temperatures employed to minimize nitrogen poisoning.

The dewaxing temperature is a critical parameter for increasing cycle length. Dewaxing at low temperature, less than 620° F., preferably less than 600° F., and most preferably less than 575° F., favors low aging rates. At conventional dewaxing temperature of start-of-cycle at 560° to end-of-cycle at 675° F., aging rates are high (2°-10° F./day). Although an explanation for these observations is not obvious, there may be two competing reactions taking place: dewaxing and poisoning as discussed above. The aging process is related to diffusion of the poisons into the zeolite and the elimination of active sites and/or bulky poisons on the surface of the zeolite react to become smaller and thus penetrate the pore and poison the active sites. Of course, the dewaxing reaction is still taking place, but at an unfavorable rate.

When dewaxing temperatures are below about 620° F., preferably about 600° F., and most preferably about 575° F., the poisoning reaction is much less because diffusion is slower and the rate of reaction to form smaller poisons is lower. The dewaxing reaction is now more efficient. As a result, aging rates are very low.

In order to operate within the temperature range where the aging rate is low, it is necessary to consider two other process variables, namely, catalyst activity and space velocity (LHSV). The catalyst activity is measured by the alpha test described below. The alpha of the catalyst or zeolite portion of the catalyst may be measured, wherein catalyst alpha equals zeolite alpha multiplied by weight fraction of zeolite on catalyst. Therefore, combining low temperature and high alpha value reduces the aging rate and increases cycle time.

There must be some flexibility and trade-off between catalyst activity and space velocity in order to dewax at low temperatures. It is possible that a catalyst having an alpha value of 50 to 100 based on zeolite will age slowly if the space velocity is low, say at 0.1 LHSV. Conversely, with more active catalysts of alpha, about 200 to 450 based on zeolite, space velocities approaching 1 LHSV or higher may suffice.

Figure 2:
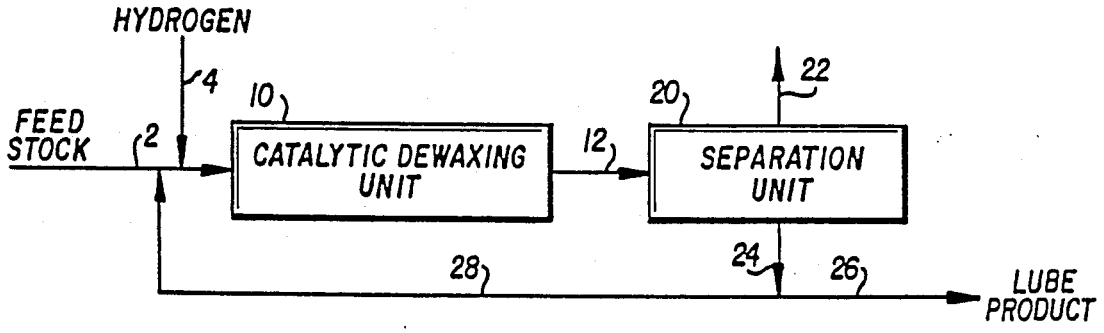
FIG. 2 is a block flow diagram of a second embodiment of the invention showing a single dewaxing unit, a separation unit, and a continuous recycle stream to the single dewaxing unit.

FIG. 2 shows a second embodiment of the invention in which a feedstock 2 is combined with a hydrogen stream 4 and passes into a dewaxing unit 10 under the operating conditions described above. The dewaxing unit 10 produces a dewaxing reactor effluent 12 which passes to a separation unit 20 to form a vapor stream 22 and a liquid stream 24. The liquid stream 24 is separated into a product stream 26 and a recycle stream 28. Recycle stream 28 is then combined with the feedstock 2 and recycled to the catalytic dewaxing unit 10. The recycle ratio of recycle stream 28 to feedstock 2 ranges from about 0.5 to about 20.

The combination of conditions and catalyst activity described above in a single unit without product recycle reduces aging rates and allows fresh catalyst performance to be restored by simple hydrogen reactivation. The product separation and recycle of separated liquid products result in additional benefits. The separation and recycle allow dilution of fresh feed by once processed and partially dewaxed stock, allowing the level of light hydrocarbons, developed as light by-products present in the reactor, to be substantially reduced. The reduction in partial pressure of light hydrocarbons (less than 400° F. b.p.) allows the reactor to achieve the same pour point product while operating at a lower temperature than a single pass unit. The recycle allows the unit 10 to operate longer, at the desirable conditions and catalyst activity outlined above than a unit without product separation and recycle, thus compounding the benefits of low temperature operation.

Figure 3:
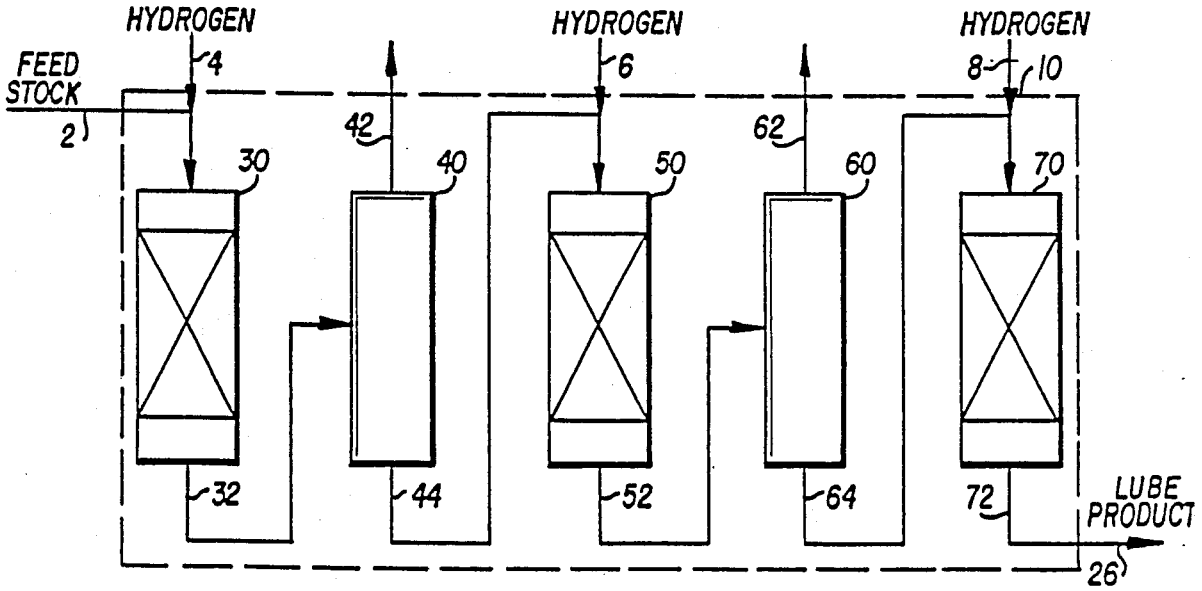
FIG. 3 is a block flow diagram of a third embodiment of the invention showing a plurality of dewaxing reactors with inter-reactor separation of vapors and liquids.

FIG. 3 shows a third embodiment of the invention, in which the dewaxing unit 10 comprises a series of catalytic dewaxing reactors 30, 50, 70, with separation units 40, 60 located between the reactors 30, 50, 70. The feedstock 2 passes into the first catalytic dewaxing reactor 30, which operates at conditions described below, wherein a portion of the feedstock 2 is cracked to lighter products described below. A first effluent stream 32 from the first reactor 30 passes to the first separation unit 40 to form a first vapor stream 42 and a first liquid stream 44. The first liquid stream 44 then passes to a second catalytic dewaxing reactor 50 to crack a second portion of the first liquid stream 44 to lighter products, described below. The first effluent stream 32 preferably has a desired intermediate pour point between about 20° and about 100° F. (−7°, +38° C.). Generally, the pour points of the first effluent stream 32 and the first liquid stream 44 are within 10° F. (6° C.) of one another. A second effluent stream 52 passes from the second reactor 50 to a second separation unit 60 to produce a second vapor stream 62 and a second liquid stream 64. The second liquid stream 64 then passes to a third catalytic dewaxing reactor 70, wherein a third portion of hydrocarbons from the second liquid stream 64 are cracked to lighter products. The lighter products include $C_3$− gases and paraffinic and olefinic fragments, some of which remain in the lube oil boiling range, but most of which are in the 400° F.− b.p. range. The third reactor 70 produces a third effluent stream 72, which forms the lube product stream 26 which is passed to downstream processing, such as hydrofinishing into final product. The lube product stream 26 typically has a pour point of at most about 40° F. (4° C.), and preferably at most about 20° F. (−7° C.). The second effluent stream 52 will preferably have a pour point between that of first effluent stream 32 and that of lube product stream 26.

Reactors 30, 50, 70 operate within the same ranges of conditions of temperature, pressure, space velocity and hydrogen feed rate as in the above embodiments and employ a shape-selective catalyst having an alpha value between about 50 and about 900 based on zeolite, preferably between about 70 and about 800 based on zeolite, and most preferably between about 200 and about 450, as in the above embodiments. The overall space velocity is sufficient to dewax the feedstock 2 to produce a product stream 76 of desired pour point and maintain a low average catalyst aging rate. The pour point is at most about 60° F., preferably at most 40° F., and most preferably at most about 20° F. The average catalyst aging rate is at most about 2° F. per day, preferably at most about 1° F. per day, and most preferably at most 0.3° F. per day. The overall space velocity is preferably between about 0.01 and about 2 LHSV, and preferably about the same in each reactor 30, 50, 70. The hydrogen feed rate ranges from about 500 to about 10,000 SCF/bbl of liquid feed to each reactor 30, 50, 70, namely feedstock 2, first liquid stream 44, and second liquid stream 64, respectively, with hydrogen introduced via lines 4, 6 and 8.

The separation units 40, 60 operate by lowering the pressure and flashing the first effluent stream 32 and second effluent stream 52 or by distilling the effluent streams 32, 52. The separation removes those by-product materials boiling below 400° F., and preferably those boiling below 600° F. The compositions of the liquid streams 44, 64 and of the vapor streams 42, 62 may be adjusted, depending upon the final product specification required, by adjusting the temperature and pressure in each of the respective separation units 40, 60. The vapor streams 42, 62 may be sent to downstream processing, such as distillation or hydrotreating.

Although the embodiment of FIG. 3 includes a three-reactor system with inter-reactor separation, two reactors may be adequate. Also, the choice of temperature policy in the reactors may be tailored to achieve a desired product pour point. For example, the temperature of the first reactor may be increased to reduce the first effluent pour point, and thus allow the temperature of the second reactor (or third) to be relatively lower to meet target pour point. Additionally, space velocity distribution among the reactors may be tailored to achieve a desired product pour point.

The advantage of a multiple reactor system with inter-reactor separation, as compared to a single reactor without product separation and recycle, or compared to multiple reactors without inter-reactor separation, includes quick removal of the light by-products of the cracking of hydrocarbon waxes. It was found that the light by-products inhibit the cracking of remaining uncracked stock. It is theorized that the light by-products react with the remaining uncracked stock because the light reaction by-products are often olefins which may cyclize and/or alkylate to heavier components in the stock. It is also theorized that the light by-products, such as light hydrocarbons, especially at 400° F.− b.p., inhibit the reaction of the heavier uncracked stock because they are more rapidly absorbed into the catalyst volume, thus in effect accelerating the measured rate of catalyst aging for dewaxing to the desired product.

The application of the temperature, space velocity and catalyst activity ranges of the invention results in additional benefits when employed in a series of reactors as in the third embodiment. The series of reactors with inter-reactor separation has been found to achieve the same pour point reduction, at lower temperatures and lower catalyst aging rates, as a single reactor without product separation and recycle or multiple reactors without inter-reactor separation. Therefore, multiple reactors with inter-reactor separation may operate longer within the desired ranges of temperature, space velocity and catalyst activity than a single reactor or multiple reactors without inter-reactor separation.

Catalysts

The invention is effective for improving the dewaxing performance of intermediate pore zeolites, which are described below, because the temperature limitation of the invention reduces catalyst poisoning which forms residues after hydrogen regeneration. The residues are believed to inhibit the dewaxing activity of most dewaxing catalysts.

The catalysts employed in the dewaxing units disclosed above may be the same type or different. However, they will possess shape-selective paraffin cracking ability and have high alpha activity of 50 to 900, preferably 200 to 450, based on zeolite. Catalysts that have shape-selective qualities include crystalline zeolite catalysts. These materials may be bound in a variety of matrices, such as those containing silica and alumina or silica or alumina alone. The catalysts may contain up to 15% metals that are known to possess a hydrogenation ability. The preferred hydrogenation components are the noble metals of Group VIII, especially platinum and palladium, but other noble metals, such as iridium, ruthenium or rhodium, may also be used. Combinations of noble metals with non-noble metals, such as nickel, rhenium, tungsten, chromium and molybdenum, are useful for dewaxing. Combinations of Group VIB and Group VIII are also useful for dewaxing. Base metal hydrogenation components may also be used, especially nickel, cobalt, molybdenum, tungsten, copper or zinc.

The metal may be incorporated into the catalyst by any suitable method such as impregnation or exchange onto the zeolite. The metal may be incorporated in the form of a cationic, anionic or a neutral complex, such as $Pt(NH_3)_4^{2+}$, and cationic complexes of this type are found convenient for exchanging metals onto a zeolite. Anionic complexes are also useful for impregnating metals into the zeolites.

A portion of the novel class of zeolites useful for dewaxing are termed medium or intermediate pore size zeolites and are characterized by an effective pore size of generally less than about 7 Angstroms, and/or pore windows in a crystal formed by 10-membered rings. The medium or intermediate pore size zeolites are represented by those zeolites having the structure of ZSM-5, ZSM-11, ZSM-23, ZSM-35, ZSM-38, ZSM-48 and TMA (tetra methyl ammonium) Offretite.

By "intermediate pore size", as used herein, is meant an effective pore aperture probably in the range of about 5 to 6.5 Angstroms when the zeolite is in the H-form. Zeolites having pore apertures in this range tend to have unique zeolite characteristics and to be particularly useful in dewaxing. Unlike small pore size zeolites, such as erionite and chabazite, they will allow hydrocarbons having some branching into the zeolite void spaces. Unlike larger pore size zeolites, such as the faujasites, they can differentiate between n-alkanes and slightly branched alkanes having, for example, quaternary carbon atoms.

The effective pore size of zeolites can be measured using standard adsorption techniques and compounds of known minimum kinetic diameters. The preferred effective pore size range is from about 5.3 to 6.2 Angstroms. See Breck, *Zeolite Molecular Sieves,* 1974 (especially Chapter 8), and Anderson et al, *J. Catalysis* 58, 114 (1979), both of which are incorporated herein by reference.

Intermediate pore size zeolites in the H-form will typically admit molecules having kinetic diameters of 5.0 to 6.5 Angstroms with little hindrance. Examples of such compounds (and their kinetic diameters in Angstroms) are: n-hexane (5.3), 3-methylpentane (5.5), benzene (5.85), and toluene (5.8). Compounds having kinetic diameters of about 6 to 6.5 Angstroms may be admitted into the pores, depending on the particular zeolite, but do not penetrate as quickly and in some cases are effectively excluded. Compounds having kinetic diameters in the range of 6 to 6.5 Angstroms include: cyclohexane (6.0), 2,3-dimethylbutane (6.1), m-xylene (6.1), and 1,2,3,4-tetramethylbenzene (6.4). Generally compounds having kinetic diameters of greater than about 6.5 Angstroms do not penetrate the pore apertures and thus are not absorbed into the interior of the zeolite lattice. Examples of such larger compounds include: hexamethylbenzene (7.1), 1,3,5-trimethylbenzene (7.5), and tributylamine (8.1).

In performing adsorption measurements to determine effective pore size, standard techniques are used. It is convenient to consider a particular molecule as excluded if it does not fill at least 80% of the zeolite pore volume in less than about one hour (p/po=0.5; 25° C.).

The acid cracking activity of zeolite catalysts is conveniently defined by the alpha scale described in an article published in *Journal of Catalysis*, Vol. 6, pp. 278–287 (1966). In this text, the zeolite catalyst is contacted with hexane under conditions prescribed in the publication, and the amount of hexane which is cracked is measured. From this measurement is computed an "alpha" value which characterizes the catalyst for its cracking activity for hexane. Refinements to the alpha test are described in an article published in *Journal of Catalysis*, Vol. 61, 390–396 (1980). Both articles referred to above are incorporated herein by reference. Further background on alpha values is presented in *Nature*, Vol. 309, No. 5969, pp. 589–591, June 14, 1984. The alpha scale so described will be used herein to define activity levels for cracking n-hexane. For purposes of this invention, a catalyst with an alpha value less than about 1.0, and preferably less than about 0.5, will be considered to have substantially no activity for cracking hexane.

High alpha catalysts, required by this invention, can be made from compositions having a low silica-to-alumina ratio, preferably in the range from 25 to 40. High alpha catalyts may also be made by steaming a zeolite catalyst. Steaming will increase alpha values to some extent, but excess steaming will decrease alpha values. A combination of low silica-to-alumina ratios and steaming would be employed to achieve alphas as high as 900 to 1000 based on zeolite.

ZSM-5 is more particularly described in U.S. Pat. Nos. 3,702,886 and Re. 29,948.

ZSM-11 is more particularly described in U.S. Pat. No. 3,709,976.

ZSM-23 is more particularly described in U.S. Pat. No. 4,076,842.

ZSM-35 is more particularly described in U.S. Pat. No. 4,016,245.

ZSM-38 is more particularly described in U.S. Pat. No. 4,046,859.

ZSM-48 is more particularly described in U.S. Pat. No. 4,397,827.

The catalysts preferred for use herein include crystalline alumina silicate zeolites having a silica-to-alumina ratio of at least 12, preferably 25 to 40, a Constraint Index of about 1 to 12 and acid cracking activity (alpha value) of between about 50 and about 900, preferably about 70 to about 800, and most preferably between about 200 and about 450, based on zeolite. A suitable shape-selective catalyst for a fixed bed reactor is an HZSM-5 zeolite with alumina binder in the form of cylindrical extrudates of about 1 to 5 millimeters. HZSM-5 is a ZSM-5 type catalyst with only hydrogen on the active catalyst sites and no metals on those sites.

Zeolites characterized by such Constraint Indices induce profound transformation of aliphatic hydrocarbons to aromatic hydrocarbons in commercially desirable yields and are generally highly effective in conversion reactions involving aromatic hydrocarbons. These zeolites retain a degree of crystallinity for long periods in spite of the presence of steam at high temperature, which induces irreversible collapse of the framework of other zeolites, e.g., of the X and A type. Furthermore, carbonaceous deposits, when formed, may be removed by burning at higher than usual temperatures to restore activity. In many environments the zeolites of this class exhibit very low coke forming capability, conducive to very long times on stream between burning regenerations.

The silica-to-alumina ratio referred to may be determined by conventional analysis. This ratio is meant to represent, as closely as possible, the ratio in the rigid anionic framework of the zeolite crystal and to exclude aluminum in the binder or in cationic or other forms within the channels. Such zeolites, after activation, acquire an intracrystalline sorption capacity for normal hexane which is greater than that for water, i.e., they exhibit "hydrophobic" properties. It is believed that this hydrophobic character is advantageous in the present invention.

The type zeolites described freely sorb normal hexane and have a pore dimension greater than about 5 Angstroms. In addition, the structure preferably provides constrained access to larger molecules. It is sometimes possible to judge from a known crystal structure whether such constrained excess exists. For example, if the only pore windows in a crystal are formed by 8-membered rings of oxygen atoms, then access by molecules of larger cross-section than normal hexane is excluded and the zeolite is not of the constrained type. Windows of 10-membered rings are preferred, although, in some instances, excessive puckering or pore blockage may render these zeolites ineffective. 12-membered rings do not generally appear to offer sufficient constraint to produce the advantageous conversions, although puckered structures exist, such as TMA offretite, which is a known effective zeolite. Also, structures can be conceived, due to pore blockage or other cause, that may be operative.

Rather than attempt to judge from crystal structure whether or not a zeolite possesses the necessary constrained access, a simple determination of the "Constraint Index" may be made by passing continuously a mixture of an equal weight of normal hexane and 3-methylpentane over a sample of zeolite at atmospheric pressure, according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° and 950° F. to give an overall conversion between 10 and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}(\text{fraction of n-hexane remaining})}{\log_{10}(\text{fraction of 3-methyl pentane remaining})}$$

The Constraint Index approximates the ratio of the cracking rate constants for the two hydrocarbons. Preferred zeolites are those having a Constraint Index in the approximate range of 1 to 12. Constraint Index (CI) values for some typical zeolites are:

| Zeolite | CI |
|---|---|
| ZSM-5 | 8.3 |
| ZSM-11 | 8.7 |
| ZSM-12 | 2 |
| ZSM-35 | 4.5 |
| ZSM-38 | 2 |
| TMA Offretite | 3.7 |
| Amorphous Silica-Alumina | 0.6 |
| Erionite | 38 |

It is to be realized that the above Constraint Index values typically characterize the specified zeolites, but that such are the cumulative result of several variables used in determination and calculation thereof. Thus, for a given zeolite, depending on the temperatures employed within the aforenoted range of 550° to 950° F., with accompanying conversion between 10 and 60% for the above catalyst test, the Constraint Index may vary within the indicated approximate range of 1 to 12. Likewise, other variables, such as the crystal size of the zeolite, the presence of possible occluded contaminants and binders intimately combined with the zeolite, may affect the Constraint Index. It will accordingly be understood by those skilled in the art that the Constraint Index, as utilized herein, while affording a highly useful means for characterizing the zeolites of interest, it approximate, taking into consideration the manner of its determination, with probability, in some instances, of compounding variable extremes.

Catalytically dewaxing hydrocarbons under a range of operating conditions, which include a temperature between about 500° and about 600° F. (260°, +316° C.) and a space velocity from 0.1 to 10, and employs a shape-selective crystalline zeolite catalyst having an alpha value between about 50 and about 900 based on zeolite, will result in longer catalyst cycle length because of lowered catalyst aging rate. Cycle lengths of several months to a year may be expected. Also, by limiting the end-of-cycle reactor temperature to 600° F. (316° C.), fresh catalyst performance may be restored by simple hydrogen reactivation. By combining the above temperature, space velocity and alpha value range with separation of light by-products from reactor effluents, additional benefits may be achieved. Separating a vapor stream from a dewaxing unit effluent prior to a second pass over dewaxing catalyst removes components which inhibit further dewaxing and accelerate catalyst aging. This allows the dewaxing unit to operate within the desired temperature range for longer periods of time. The embodiment of FIG. 2 employs product separation and recycle and the embodiment of FIG. 3 employs multiple reactors with inter-reactor separation. The embodiments of both FIGS. 2 and 3 separate light by-products to extend the time for operation within the desired temperature range. The methods and apparatus of FIGS. 1 and 2 are especially simple to put into practice in current operating units, while the method and apparatus of FIG. 3 allow for a continuous process with improved vapor separation to further extend catalyst life.

EXAMPLES

All laboratory tests, described below, were conducted on a bright stock comprising a furfural-extracted, propane-deasphalted vacuum resid having the properties listed in Table 1. The catalyst was employed in a test reactor was 10 cc of unsteamed, 1/32", alumina-bound Ni-ZSM-5 zeolite containing about 65 wt % zeolite and about 1 wt % nickel. The alpha value of the zeolite was 275, while the alpha value of the overall catalyst was about 180. The tests were conducted to examine the embodiments of FIGS. 1–3 as explained in each example.

Prior to testing, the catalyst was sulfided with hydrogen sulfide.

TABLE 1

| Properties | Bright Stock |
|---|---|
| Specific Gravity | 0.9 |
| Pour Point | 120° F. |
| Viscosity | |
| KV at 100° C. | 29.71 |
| KV at 300° C. | 9.31 |
| Elemental Analysis, Wt. % | |
| Carbon | 85.53 |
| Hydrogen | 13.16 |
| Sulfur | 1.31 |
| Nitrogen (ppm) | 130 |
| Basic N (ppm) | 100 |
| Metals, ppm | |
| Nickel | 0.4 |
| Vanadium | 0.1 |
| Iron | 0.2 |
| Copper | 0.04 |
| Sodium | 5.2 |
| Furfural, ppm | 8.0 |
| CCR, wt % (Residue) | 0.71 |
| Paraffins, Wt. % | 18.8 |
| Naphthenes | 42.0 |
| Aromatics | 39.2 |
| Distillation | |
| Wt % | °F. |
| IBP | 800 |
| 5 | 912 |
| 10 | 944 |
| 20 | 980 |
| 30 | 998 |
| 40 | 1014 |
| 50 | 1030 |
| 60 | — |

Example 1

In Example 1, multiple pass dewaxing was tested. Commercial lube dewaxing is currently a single pass multi-phase trickle bed operation. Light products from the selective cracking of waxy molecules also undergo secondary reactions, which may inhibit the rate of the dewaxing reaction. Therefore these light products will be removed between passes. To determime the extent of this inhibitory effect, the results of multiple pass dewaxing using the bright stock of Table 1 as the feed were compared with results from Example 2 for a single pass study made at various space velocities. The bright stock, representing the feedstock 2, was dewaxed at 2 LHSV and 400 psig over a catalyst of unsteamed, 1/32" alumina-bound Ni-ZSM-5-extrudate containing about 1 wt % nickel. Hydrogen gas was co-fed at 2500 SCF/bbl with the feedstock 2 to a trickle bed test reactor. The test reactor had an inside diameter of ⅝", contained 10 cc of catalyst and had a thermowell ⅛" from its bottom. Reactor temperature was fixed at 545° F.

Figure 4:
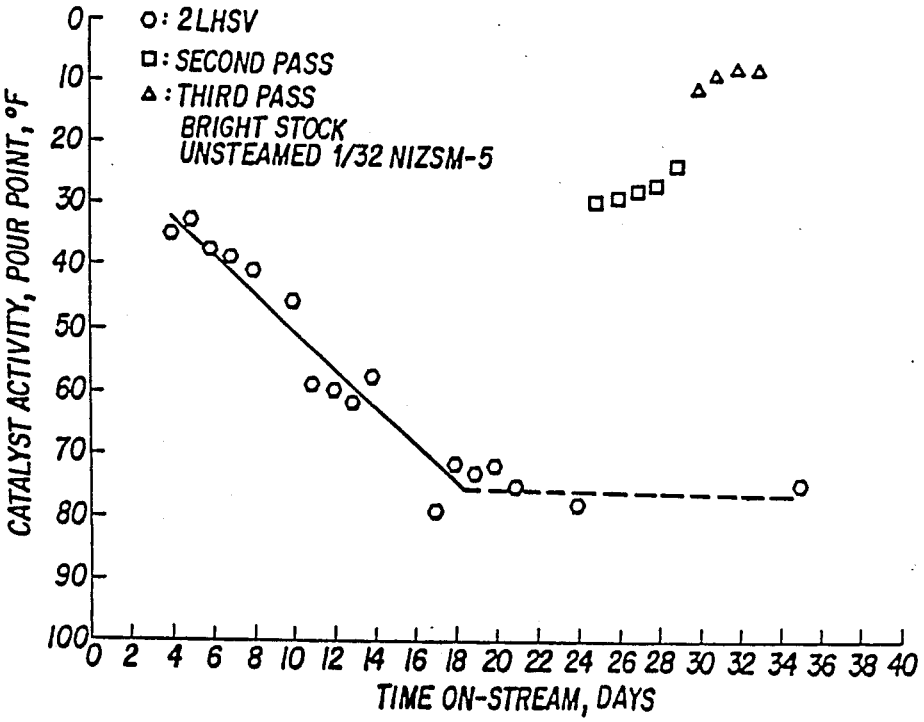
FIG. 4 is a plot of data showing catalyst activity as product pour point vs. time-on-stream.

To study multiple pass dewaxing, after an initial line out period of 2½ weeks, a partially dewaxed product of 68° F. pour point was collected for several days. This first pass product of 68° F. pour point had been subjected to a flash separation at 200° C. (atmospheric) to remove light by-products (gases and naphtha), and represents stream 44 from an inter-reactor separation. The 68° F. pour point material was then re-dewaxed over the same catalyst at 545° F. The second pass material had a pour point of 28° F. and was flashed to remove light by-products and represents stream 64. The 28° F. material was subjected to a third pass through the same catalyst at 545° F. and resulted in a lube product pour point of 8° F., which represents stream 26. This multiple pass procedure simulates operation of the three reactors 30, 50, 70 in series, as in FIG. 3, and demonstrates that multiple reactors at the same temperature, with inter-reactor separation 40, 60, may yield a product with desired pour point at a temperature of only 545° F. and a low residence time of 0.67 LHSV. Table 2 shows the product yields, pour points, viscosities and viscosity indices for this multi-pass test. FIG. 4 shows the results of Example 1 for the multi-pass tests with respect to time-on-stream in days and product pour points. It is noted that during the second and third passes, the pour points of daily samples declined with time-on-stream, suggesting that the catalyst was being reactivated by the removal of adsorbed poisons. During the line-out period and the second and third passes, the LHSV was maintained at 2 LHSV per pass. This means that the equivalent LHSV after the second and third passes was approximately 1 and 0.67 LHSV, respectively.

Example 2

In Example 2 tests simulate single pass dewaxings as in the embodiment of FIG. 1. To determine the extent of the inhibitory effect of light by-products discussed in Example 1, the results of Example 1 for multiple pass dewaxing using the bright stock of Table 1 as the feed were then compared with results from Example 2 for single pass study made at various space velocities. At the end of the multiple pass study of Example 1, single pass tests were conducted, in the same reactor over the same catalyst, in which the space velocity was varied between 2 and 0.67, and temperature and pressure held constant at the values of Example 1. Table 2 compares product yields, pour points, viscosities and viscosity indices for both the single and multi-pass tests at corresponding LHSV's. Yields for the multiple pass products are comparable to single pass when based upon cumulative yields. Viscosities and viscosity indices, at near target point, are the same as those found for single pass products.

Figure 5:
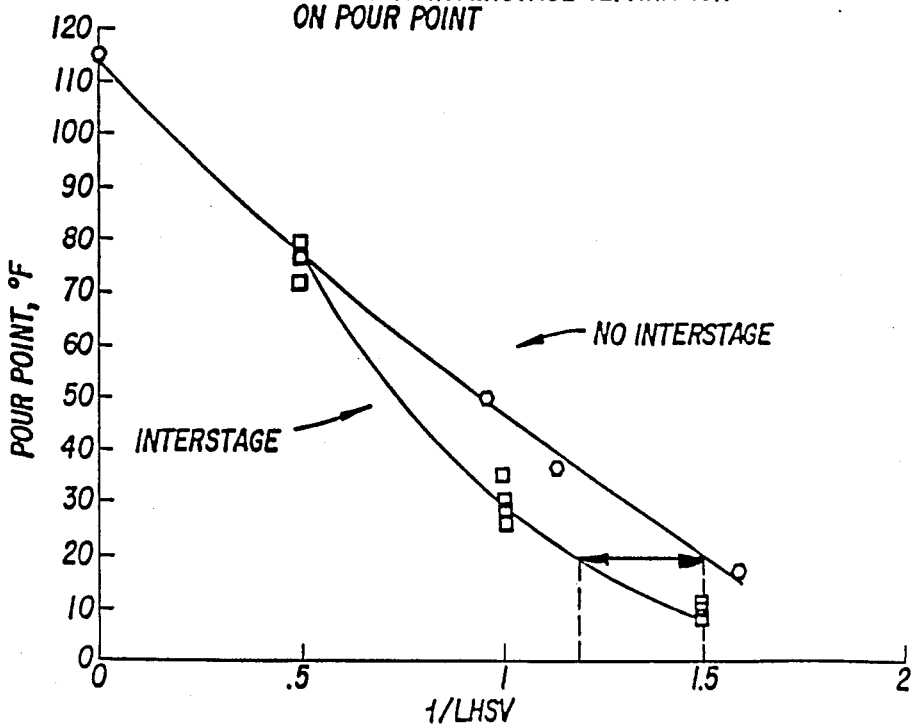
FIG. 5 is a plot of data showing pour point vs. 1/LHSV (Liquid Hourly Space Velocity)

To further determine if product inhibition had occurred, the multiple pass data were graphically compared with the single pass data. A plot of pour point vs. contact time (1/LHSV) is shown in FIG. 5. The plot shows that with inter-stage separation there is a catalyst activity advantage, as determined by the lower pour point achieved, which could be translated to about 20° F. in activity. To obtain a 20° F. pour point product, it is noted that the throughput (LHSV) of the multiple pass reactor would be 21% higher than that of the single pass reactor. These results suggest that the cracked products do inhibit the dewaxing reaction to some extent and thus could interfere with low temperature operation, although the effect is not too severe for the particular charge stock used. More waxy feeds may show a stronger effect.

The data of FIG. 5 show that the same product pour point may be achieved at higher LHSV's by a multi-reactor system with inter-reactor separation than with a single reactor system. This also implies that the same product pour point may be achieved at lower temperature, if LHSV's are kept the same, by a multi-reactor system with inter-reactor separation than with a single reactor system. This implication is supported because it is well known that temperature may be traded off for space velocity in catalytic dewaxing. Therefore it is concluded that a multi-reactor system may better take advantage of the low temperature range of this invention, namely about 500° to about 600° F. than a single reactor system.

TABLE 2

Product Yields, Pour Points and Viscosity Indices

| | Yield Wt % | Cum. Yield | Pour | KV, 40° C. | KV, 100° C. | VI |
|---|---|---|---|---|---|---|
| Single Pass | | | | | | |
| 2 LHSV | 92.4 | — | 68 | — | — | — |
| 1 LHSV | 90.9 | — | 50 | — | — | — |
| 0.67 LHSV | 86.9 | — | 18 | 496.9 | 31.98 | 95 |
| Multiple Pass | | | | | | |
| 2 LHSV | 92.4 | — | 68 | — | — | — |
| 1 LHSV | 97.1 | 89.7 | 28 | 502.4 | 32.36 | 96 |
| 0.67 LHSV | 94.9 | 85.1 | 8 | 511.2 | 32.32 | 94 |
| 2:1 Recycle 2 LHSV | 97.3 | — | 22 | 500.7 | 31.79 | 94 |

Example 3

In Example 3, tests simulated a recycle process, as shown by FIG. 2, by blending two parts (by weight) of the third pass product of Example 1 to represent recycle stream 28 (8° F. pour point) with one part of bright stock feed to represent feedstock 2. This blend (pour point 68° F.) was processed in the same reactor over the same catalyst as Example 1, still operating at 545° F. at 2 LHSV based upon the blend, and 0.67 LHSV based upon the raw bright stock. This blend was processed for 3 days and resulted in an average product pour point of 19° F. Table 2 lists the average product yield, pour point, viscosity and viscosity index for one of these processing days and compares the data with data for single pass operation without recycle. Thus, it appears that recycle under these conditions is more effective for reducing pour point of the blended feed and allows better catalyst activity at lower temperatures than single pass without recycle.

Example 4

In Example 4, it is shown that operating the test reactor under much milder conditions than would be required to produce the 20° F. pour product 26 results in an extremely low catalyst deactivation rate. The same test reactor was operated using the same catalyst type and feed as in Example 1, at a space velocity of 2 LHSV and target pour point of 20° F. to simulate the embodiment of FIG. 1. At these conditions, a first cycle length of 16 days resulted, and the aging rate was 4.7° F. per day to a temperature of about 620° F. Then the test reactor simulated the first reactor of the multi-reactor system of FIG. 3 by keeping the space velocity constant and lowering the temperature to set the target pour point at 70° F. This reduced the aging rate to less than 0.5° F. per day. This shows that the first reactor of a multiple-reactor system, as in FIG. 3, would have a lower aging rate than a single reactor system. Also, it is likely that test reactors at comparable conditions to simulate the second and third reactors of FIG. 3 would have aging rates comparable to that shown by the first reactor simulation. This indicates that the multiple-reactor system of FIG. 3 would have a lower aging rate than a single-reactor system to achieve the same final product pour point. This lower rate allows the multiple-reactor system to operate within the low temperature range longer than the single-reactor system.

Example 5

In Example 5, the bright stock representing feedstock 2 was dewaxed in a reactor to simulate a fixed bed, single stage process, as shown in FIG. 1. The catalyst is 20 cc of the same type Ni-ZSM-5 as in the above examples. The bright stock of Table 1 was dewaxed at 400 psig, at a start-of-cycle temperature from about 500° to an end-of-cycle temperature of about 600° F., and a hydrogen treat rate of 2500 SCF/bbl of feedstock to obtain a target pour point of 20° F. The reactor was operated at low temperature, as opposed to conventional operation with a start-of-cycle temperature at about 60° F. higher and end-of-cycle of typically about 675° F. The space velocity was set at 0.5 LHSV, as opposed to the space velocity of 2 LHSV employed in Example 4.

Figure 6:
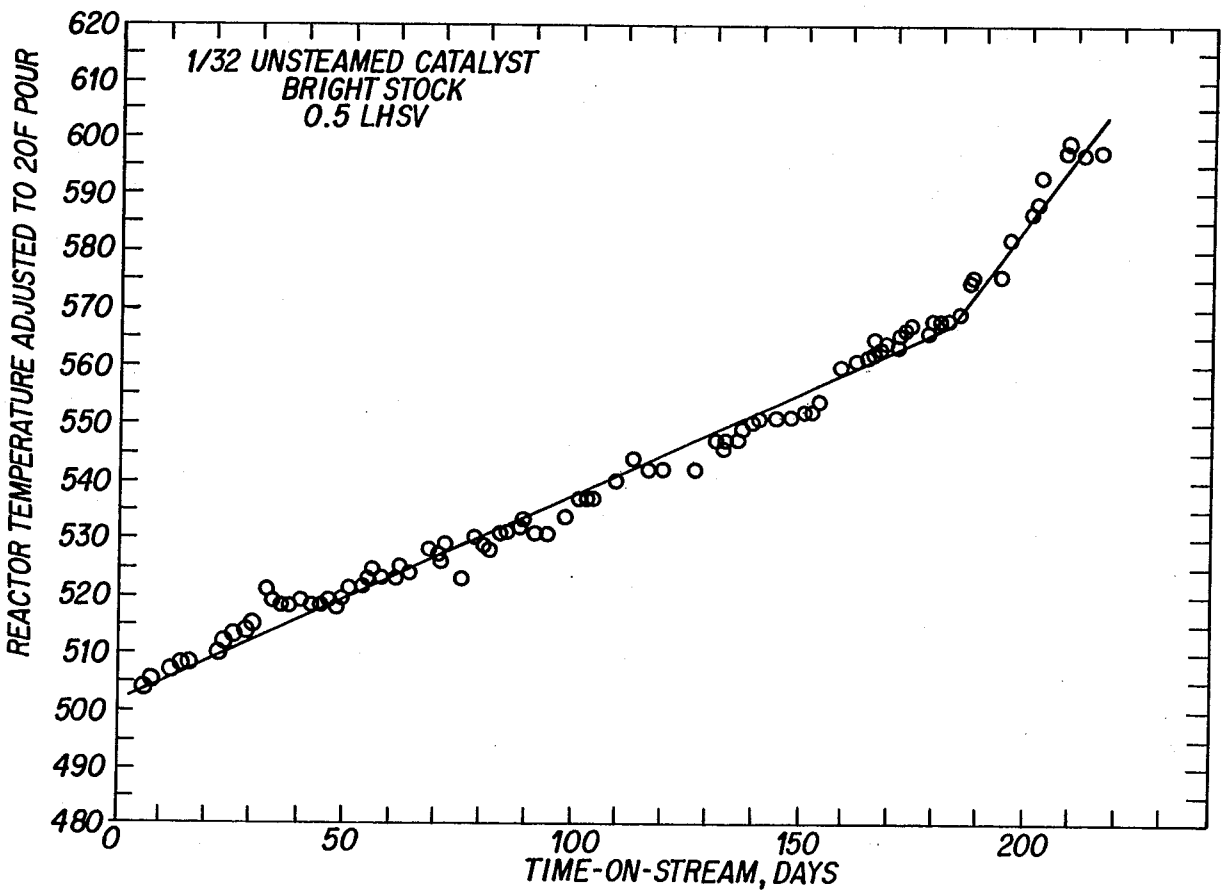
FIG. 6 is a plot of data showing reactor temperature to produce a 20° F. pour point product vs. time-on-stream.
Figure 7:
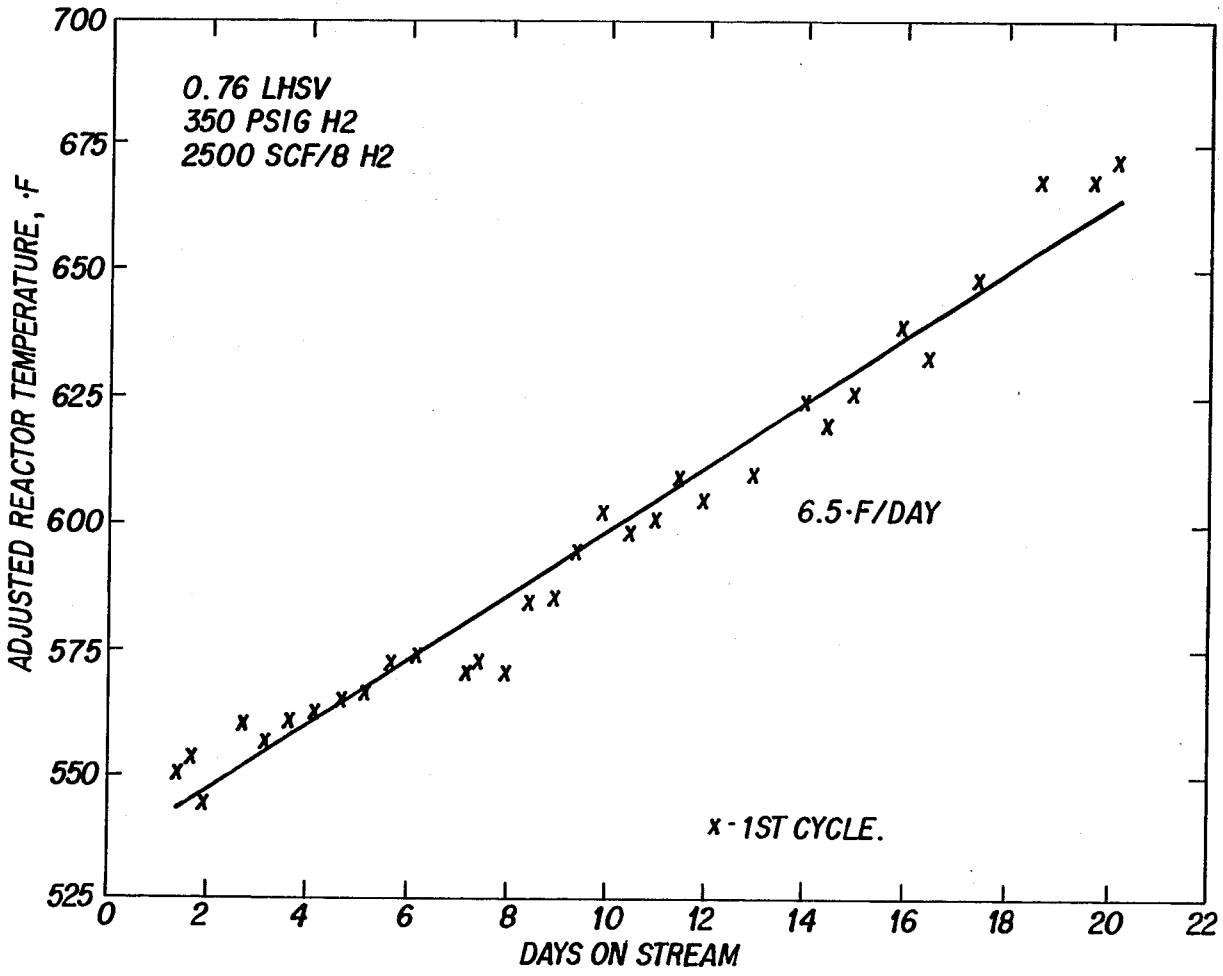
FIG. 7 (PRIOR ART)
FIG. 7 is a plot of lube oil dewaxing of bright feedstock, according to the prior art.
Figure 8:
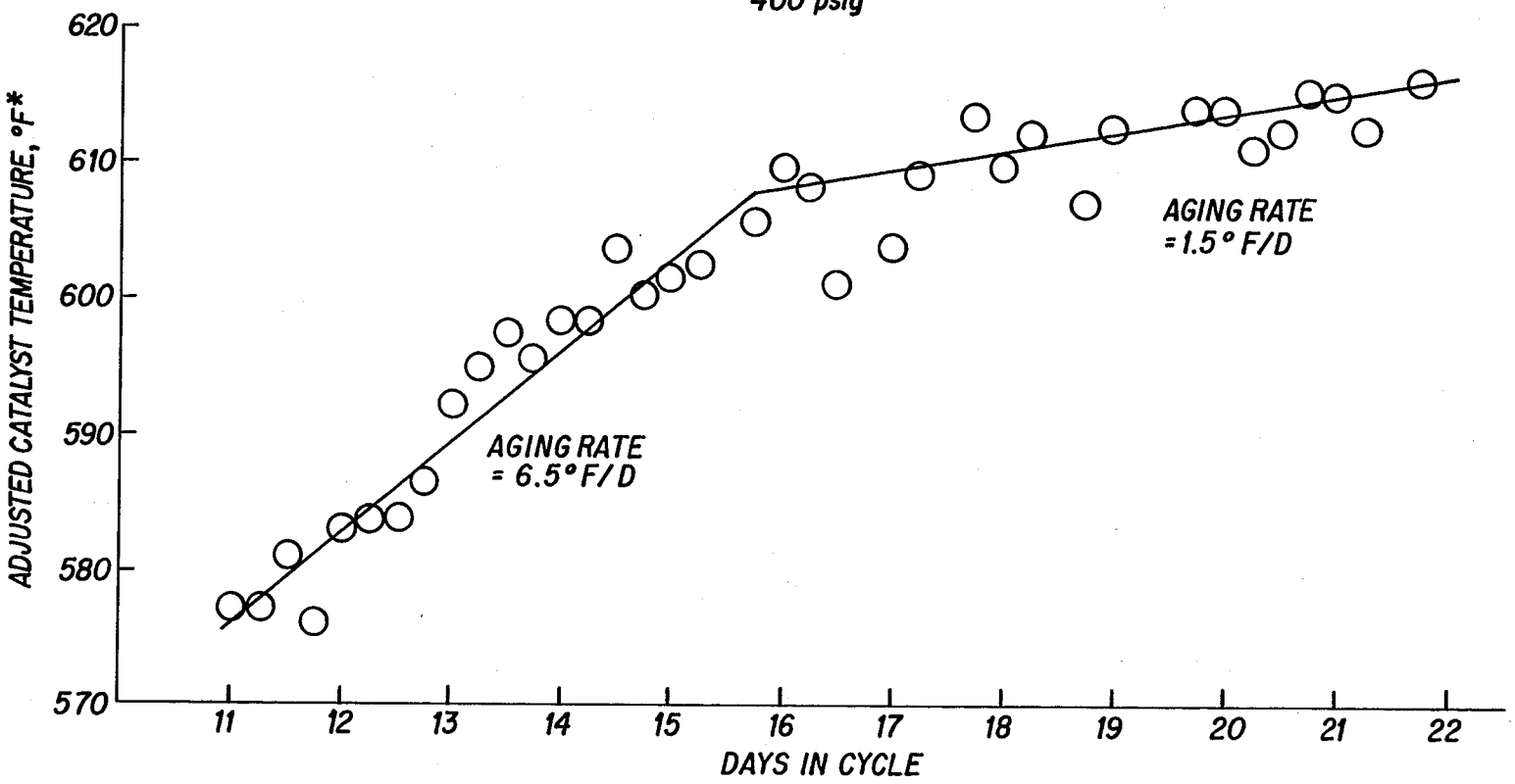
FIG. 8 (PRIOR ART)
FIG. 8 is a plot of lube oil dewaxing of light neutral feedstock, according to the prior art.

FIG. 6 shows the results of the low temperature operation by plotting reactor temperature (°F.) to obtain a 20° F. product vs. time-on-stream (days). The results indicate that combining the high alpha of about 275 on zeolite space velocity of 0.5 LHSV and operating it at low temperature between 500° and about 570° F., up to 185 days, results in a catalyst aging rate of only 0.34° F./day. Dewaxing between about 570° and 600° F. increases the aging rate to 1.1° F./day. Conventional higher temperature operation would be expected to lead to higher aging rates of about 5° F. or higher/day. This is indicated by Examples 6 and 7 below at 1 and 2 LHSV, respectively, to produce a 20° F. pour product.

Example 6

Tests were conducted at 1 LHSV to determine the effect of temperature on catalyst aging rate from about a 540° F. start-of-cycle temperature to 600° F. and then above 600° F. to an end-of-cycle temperature of about 675° F. Example 6 employs the feed of Table 1 as in the above examples, over 10 cc of a Ni-ZSM-5 type catalyst in the same reactor as Example 1. Hydrogen partial pressure was maintained at about 400 psig and hydrogen feed rate was 2500 SCF/bbl. Temperature was maintained to produce a 20° F. pour point product. The aging rate from start-of-cycle to 600° F. averaged 1.5° F./day, while the aging rate averaged 6.5° F./day above 600° F., and the cycle length to reach 600° F. was 40 days.

Example 7

Tests were conducted at 2 LHSV in a single reactor to determine the effect of temperature on catalyst aging rate from about a 560° F. start-of-cycle temperature to 600° F. and then above 600° F. to an end-of-cycle temperature of about 675° F. Temperature was maintained to produce a 20° F. pour point product, while feed, catalyst, test reactor and other operating conditions were the same as in Example 6. In the test, the aging rate below 600° F. averaged 4.7° F./day and above 600° F. averaged from start-of-cycle to 12.5° F./day, and the cycle length to reach 600° F. was 9 days.

Example 8

In Example 8, bright stock representing feedstock 2 was dewaxed in a reactor to simulate the single dewaxing unit 10 of FIG. 1 over a range of conditions from start-of-cycle to an end-of-cycle temperature of 620° F. and compared with running bright stock under the same conditions, except now running from start-of-cycle to an end-of-cycle temperature of 675° F., as presently used in commercial practice. 5 gms of Ni-ZSM-5 catalyst, which are taken at 620° F. end-of-cycle, contain the equivalent of 26 grams per 100 grams catalyst of residue before hydrogen regeneration. 5 gms of catalyst taken to an end-of-cycle temperature of 675° F. have the equivalent of 60 grams per 100 grams catalyst of residue before hydrogen regeneration, showing the importance of limiting the temperature in the dewaxing unit 10. By limiting the temperature to 620° F., hydrogen reactivation of catalyst in the dewaxing unit 10 is shown to be easier and more complete than if the temperature limit of 675° F. is used. Thus, the temperature limit of 600° F. and more preferably 575° F., would also provide easier and more complete regeneration. A more complete hydrogen reactivation will result in a second cycle performance which should be identical to or very close to that found in the first cycle.

While specific embodiments of the method and apparatus aspects of the invention have been shown and described, it should be apparent that many modifications can be made thereto without departing from the spirit and scope of the invention. Accordingly, the invention is not limited by the foregoing description, but is only limited by the scope of the claims appended thereto.

We claim:

1. A method for catalytic dewaxing comprising the step of:

contacting a stream consisting essentially of a lube oil feedstock and hydrogen, said lube oil feedstock having at least 90 wt % of compounds having a boiling point of at least 850° F., with an intermediate pore crystalline zeolite dewaxing catalyst having an alpha value between about 200 and about 900 based on said zeolite, at non-steady state conditions including a dewaxing temperature between about 490° and about 620° F., and a space velocity sufficient to reduce the pour point of said feedstock by at least 10° F. and to result in an average catalyst aging rate less than about 2° F. per day, said method thereby producing a dewaxed effluent having a pour point of at most about 60° F.

2. The method of claim 1, wherein said contacting occurs at a pressure between about 100 and about 2000 psig.

3. The method of claim 2, wherein said alpha value is between about 200 and about 800 and said dewaxed effluent has a pour point of at most about 40° F.

4. The method of claim 3, wherein said dewaxing temperature is between about 500° and about 600° F.

5. The method of claim 4, wherein said catalyst aging rate is less than about 1° per day.

6. The method of claim 5, wherein said dewaxing temperature is between about 500° and about 575° F.

7. The method of claim 6, wherein said alpha value is between about 200 and about 450.

8. The method of claim 7, wherein said catalyst has the structure of a zeolite selected from the group consisting of ZSM-5, ZSM-11, ZSM-23, ZSM-35, ZSM-38, ZSM-48 and TMA Offretite.

9. The method of claim 8, wherein said dewaxed effluent pour point is at most about 20° F.

10. The method of claim 9, wherein said space velocity ranges between about 0.01 and about 2.0 LHSV.

11. The method of claim 10, wherein said lube oil feedstock is a bright lube oil feedstock, and said aging rate is less than about 0.3° F./day.

12. The method of claim 11, wherein said dewaxing temperature is below an equilibrium dewaxing temperature of said catalyst.

13. The method of claim 7, wherein said method further comprises the steps of separating said dewaxed effluent to form a liquid stream and a vapor stream, and recovering a lube product stream from said separated liquid stream.

14. The method of claim 13, wherein said recovery step comprises combining a portion of said lube product stream with said feedstock prior to catalytic dewaxing.

15. The method of claim 7, wherein said dewaxing step comprises the steps of:

catalytically dewaxing said feedstock to produce a first effluent stream having an intermediate pour point;

separating said first effluent stream to obtain a first vapor stream and a first liquid stream;

catalytically dewaxing said first liquid stream to produce a second effluent stream; and recovering a lube product stream, from said second effluent stream, having a pour point less than that of said first effluent stream.

16. The method of claim 15, further comprising:

separating said second effluent stream to obtain a second vapor stream and a second liquid stream; and catalytically dewaxing said second liquid stream to produce said lube product stream prior to said recovery step.

17. The method of claim 18, wherein each of said dewaxing steps has a hydrogen feed rate of about 500 to about 10,000 standard cubic feet per barrel of feedstock.

18. The method of claim 1, further comprising the steps of:

reactivating said catalyst by contacting it with hydrogen after said lube oil contacting step; and contacting a stream consisting essentially of a lube oil feedstock and hydrogen, said lube oil feedstock having at least 90 wt % of compounds having a boiling point of at least 850° F., with said reactivated catalyst, wherein said reactivated catalyst has an alpha value between about 200 and about 900 based on said zeolite, at non-steady state conditions including a dewaxing temperature between about 490° and about 620° F., and a space velocity sufficient to reduce the pour point of said second feedstock by at least 10° F. and to result in an average catalyst aging rate less than 2° F. per day, said method thereby producing a dewaxed effluent having a pour point of at most about 60° F.

19. The method of claim 18, wherein said dewaxed effluents have a pour point of at most about 20° F. and said dewaxing catalyst and reactivated catalyst have an alpha value between about 200 and about 450 and a structure of a zeolite selected from the group consisting of ZSM-5, ZSM-11, ZSM-23, ZSM-35, ZSM-38, ZSM-48 and TMA Offretite.

20. A method for catalytic dewaxing comprising the step of:

contacting a stream consisting essentially of a lube oil feedstock and hydrogen, said lube oil feedstock having at least 90 wt % of compounds having a boiling point of at least 850 F., with a zeolite catalyst having the structure of ZSM-5 and an alpha value between about 200 and about 450 based on said zeolite, at non-steady state conditions including a dewaxing temperature between about 500° and 575° F., and a space velocity sufficient to produce a dewaxed effluent having a pour point of at most about 20° F. and to result in an average catalyst aging rate less than about 1° F. per day, wherein said dewaxing temperature is below an equilibrium dewaxing temperature for said catalyst.

* * * * *